US008469225B2

(12) United States Patent
Fredland

(10) Patent No.: US 8,469,225 B2
(45) Date of Patent: Jun. 25, 2013

(54) SEMI-RIGID BEVERAGE RECEPTACLE

(75) Inventor: Richard Fredland, Bend, OR (US)

(73) Assignee: Silipint, Inc., Bend, OR (US)

( * ) Notice: Subject to any disclaimer, the term of this patent is extended or adjusted under 35 U.S.C. 154(b) by 0 days.

(21) Appl. No.: 13/248,505

(22) Filed: Sep. 29, 2011

(65) Prior Publication Data

US 2012/0181291 A1 Jul. 19, 2012

Related U.S. Application Data

(60) Provisional application No. 61/433,648, filed on Jan. 18, 2011.

(51) Int. Cl.
*A47G 19/22* (2006.01)

(52) U.S. Cl.
USPC ..... 220/703

(58) Field of Classification Search
USPC ..... 220/DIG. 12, 602, 662, 660, 600, 220/669; D7/537, 560, 516, 515, 514, 533, D7/509
See application file for complete search history.

(56) References Cited

U.S. PATENT DOCUMENTS

| | | | | | |
|---|---|---|---|---|---|
| D92,219 | S | * | 5/1934 | Walton | D7/509 |
| 1,986,824 | A | * | 1/1935 | Keiding | 229/404 |
| 2,140,327 | A | * | 12/1938 | Mould | 472/51 |
| D164,618 | S | * | 9/1951 | Yuchtmann | D7/537 |
| 2,895,636 | A | * | 7/1959 | Martin | 220/574 |
| 4,609,113 | A | * | 9/1986 | Seki | 215/382 |
| 5,226,551 | A | * | 7/1993 | Robbins, III | 220/8 |
| 5,384,138 | A | * | 1/1995 | Robbins et al. | 426/111 |
| 6,866,905 | B1 | * | 3/2005 | Sandstrom et al. | 428/34.1 |
| 2003/0066838 | A1 | * | 4/2003 | Wang | 220/660 |
| 2003/0160055 | A1 | * | 8/2003 | Stewart-Stand | 220/666 |
| 2007/0062961 | A1 | * | 3/2007 | Rigas | 220/703 |
| 2007/0267424 | A1 | * | 11/2007 | Marks | 220/703 |

* cited by examiner

*Primary Examiner* — Robert J Hicks
(74) *Attorney, Agent, or Firm* — Woodard, Emhardt, Moriarty, McNett & Henry LLP

(57) ABSTRACT

The present invention relates generally to drinkware and in particular to drinkware formed from pliable materials, such as silicone. When used in the present invention, the flexibility of the silicone material differentiates the new drinkware from existing drinkware in a number of ways. First, the novel drinkware is pliable, foldable and bendable, so that it can safely travel without fear of breakage or injury. Furthermore, the form will always return to its original shape, and there will be no wear, tear or fatigue to the material, thereby enabling the drinkware to be stored in a smaller space than that required by drinkware formed from rigid materials.

19 Claims, 2 Drawing Sheets

SEMI-RIGID BEVERAGE RECEPTACLE

CROSS REFERENCE TO RELATED APPLICATIONS

The present application claims the benefit of U.S. Provisional Patent Application Ser. No. 61/433,648 filed Jan. 18, 2011 entitled "SEMI-RIGID BEVERAGE CONTAINER" which is hereby incorporated by reference in its entirety to the extent not inconsistent.

FIELD OF THE INVENTION

The present disclosure broadly concerns beverage receptacles. More particularly, the present disclosure relates to flexible/semi-rigid beverage receptacles.

BACKGROUND

The present invention is directed to improvements in beverage receptacles. Traditionally, the majority of beverage receptacles were made of glass. This included everyday reusable glassware, beer and soda bottles, wine bottles, milk jugs, and the like. However, glass receptacles are fragile and thus difficult to transport. To address this problem, as well as others, beverage receptacles made from a number of different materials came about. These materials include different varieties of plastic as well as aluminum. However, the overwhelming majority of these materials were designed to create a rigid beverage receptacle. It was commonly accepted that a semi-rigid beverage receptacle was undesirable. For example, compression of the sides of a receptacle could reduce its effective volume leading to spillage. Nevertheless, when the need for cheaper and/or disposable beverage receptacles came along, semi-rigid materials such as thinner plastics, paper, and polystyrene foam were used. However, these cheaper beverage receptacles all suffered from the same problem—they were subject to fatigue and failure.

Despite the disadvantages of disposable beverage receptacles, they do offer some advantages, including being easily deformed and/or compressed. Furthermore, as opposed to receptacles made from glass, disposable beverage receptacles are less fragile. Such characteristics reduce the storage space needed for such receptacles, when not full of a select beverage. However, due to fatigue, any significant deformation or folding typically results in a tear, rendering the receptacle inoperable, and therefore the value of these features are realized only after the receptacle has been thrown away and it is being hauled off.

Therefore it is an object of the present invention to provide a semi-rigid beverage receptacle which exhibits the ability to deform and/or be compressed without suffering from fatigue. It is a further object of the invention to provide semi-rigid beverage receptacle with sufficiently rigid sides to prevent undesirable spilling when in use, while remaining flexible enough so as to be foldable and compressible when not in use. It is a still further object of the invention to provide a beverage receptacle which is, for all practical purposes, unbreakable.

SUMMARY

The present disclosure includes certain embodiments for a semi-rigid beverage receptacle. In certain embodiments of the present invention, a semi-rigid beverage receptacle formed substantially of food-grade silicone is provided. In certain forms, the silicone beverage receptacle is in the form of a pint glass, mug, tumbler, or the like.

Further objects, features and advantages of the present invention shall become apparent from the detailed drawings and descriptions provided herein. Each embodiment described is not intended to address every object described herein, and each embodiment does not include each feature described. Some or all of these features may be present in the corresponding independent or dependent claims, but should not be construed to be a limitation unless expressly recited in a particular claim.

DETAILED DESCRIPTION

Figure 1:
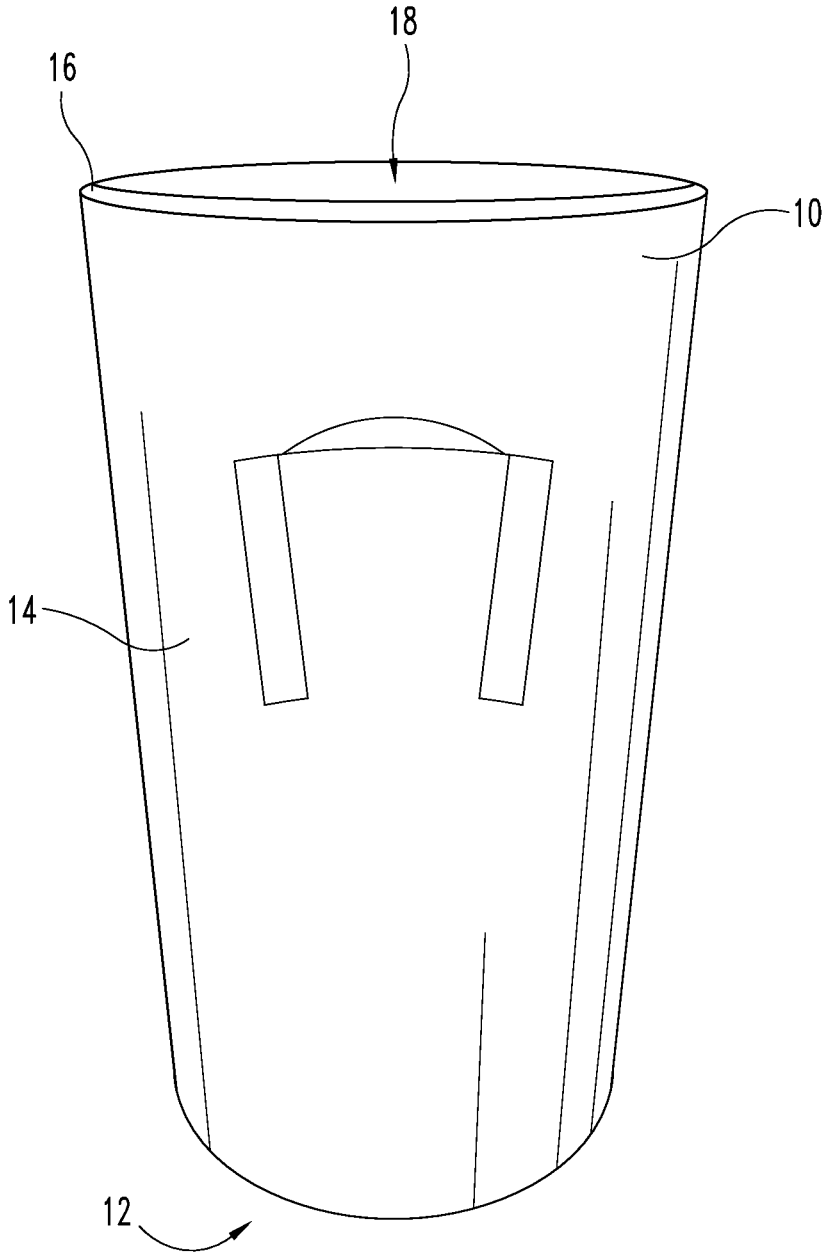
FIG. 1 is a perspective view of a beverage receptacle according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. Additionally, in the following description, like reference characters designate like or corresponding parts throughout the several views.

The present invention relates generally to drinkware and in particular to drinkware formed from pliable materials, such as silicone. The novel non-rigid drinkware may be formed into any one of the traditional glassware shapes, including: pint glass, mug, flute, wine glass, shot glass, rocks glass, stein, chalice, tumbler, goblet, stemware, teacup, tankard, pilsner, juice glass, and coffee cup, to name just a few representative examples. Other beverage and/or liquid containing shapes are contemplated and desired to be protected. However, for purposes of illustration, the novel beverage receptacles of the present invention will be described herein with respect to an exemplary pint glass.

Regardless of the shape or size, by being manufactured principally of silicone, the novel drinkware enjoys the following desirable characteristics: it is dishwasher safe, microwave safe, oven safe up to and exceeding 600° F., flexible/foldable, and under normal circumstances—unbreakable. Furthermore, when used in the present invention, the flexibility of the silicone material differentiates the drinkware of the present invention from existing drinkware in a number of ways. First, the novel drinkware is pliable, foldable and bendable, so that it can safely travel without fear of breakage or injury. Furthermore, the form will easily return to its original shape, absent any appreciable wear or tearing/fatigue to the material, thereby enabling the drinkware to be stored in a smaller space that required by drinkware formed from rigid materials. Furthermore, the novel drinkware does not suffer from the breaking concerns presented by traditional glassware.

According to FIG. 1, an illustrative semi-rigid beverage receptacle 10 is shown from a perspective view. Receptacle 10 is shown in the form of a pint glass and includes a base 12, a sidewall 14, and a rim 16. In the illustrated embodiment, rim 16 is annular in shape and is defined by the distal end of sidewall 14 with respect to base 12. Rim 12 defines the opening to cavity 18 which is formed by base 12 and sidewall 14. Cavity 18 of receptacle 10 is sized so as to provide the capacity for approximately 16 or 20 fluid ounces, depending upon American or European standards. Furthermore, in certain embodiments, receptacle 10 has a base 12 which is circular in shape and has a diameter of between 2.25 and 2.75". Additionally, the vertical height of receptacle 10, and thus sidewall 14, is between 5 and 6".

Figure 2:
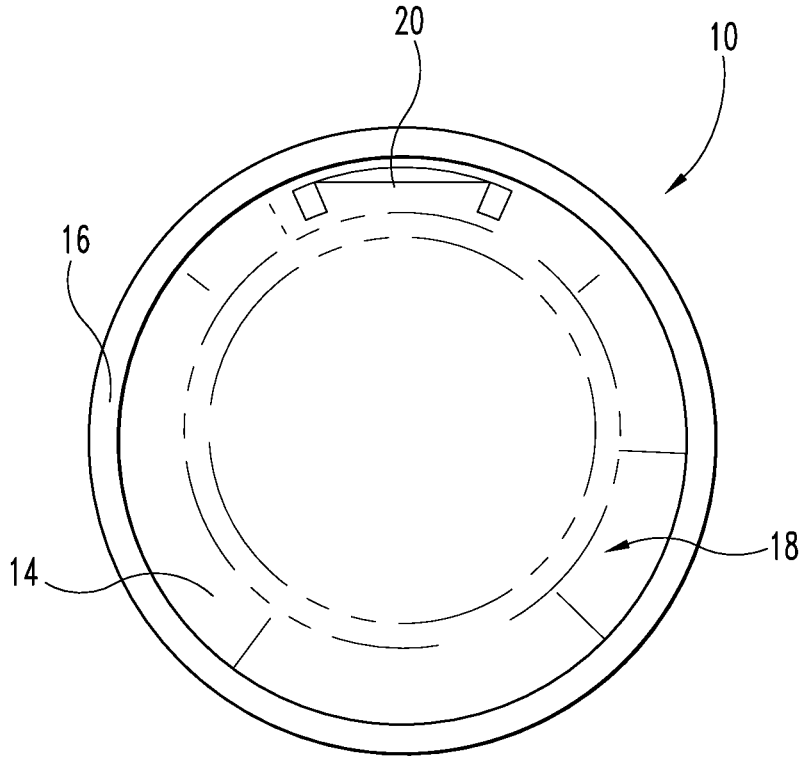
FIG. 2 is a top view of the beverage receptacle of FIG. 1.

Turning to FIG. 2, a top view of the illustrative semi-rigid beverage receptacle 10 of FIG. 1 is shown from a top view. As can be seen in the embodiment illustrated, the sidewall 14 has a thickness of approximately 3/16" which is sufficient to provide the appropriate durometer (stiffness of material). Sidewall 14 should be both rigid enough to maintain its shape when gripped, yet soft enough to exhibit its functional durability and pliability. Alternatively, in certain other embodiments, the thickness of the sidewall 14 may be between 1/16" and 1/2", depending upon the desired rigidity. As will be appreciated by those of skill in the art, other thicknesses are contemplated and should be considered within the scope of the present invention. Furthermore, the thickness and durometer of the materials utilized will vary depending on the particular shape, size and overall design of the beverage receptacle desired. For example, a taller and thinner glass, such as a flute, would require a more rigid material to properly maintain its shape than would be required for a much shorter rocks glass.

As can also be seen in FIG. 2, the inside surface of receptacle 10 is polished smooth to allow easy cleaning and improve the pour of beverages contained therein. Although not shown, it shall be appreciated that many different textures and patterns may be applied to the outside of sidewall 14 and/or the remaining portions of receptacle 10, such as to enhance its gripability, aesthetics, or to include a design element.

The novel receptacle 10 shown in FIGS. 1 and 2, according to the illustrated embodiment, is formed principally or entirely from silicone—a synthetic rubber. The novel receptacle may be formed by suitable manufacturing methods such as injection molding or the like. Silicone is a low taint, non-toxic material, which meets the necessary requirements when contact with food is required. Silicone is already important product in the cookware industry, particularly bakeware and kitchen utensils, where rigidity is not a primary concern. It is used as an insulator in heat resistant potholders and similar, however it is more conductive of heat than the less dense fiber-based ones. Silicone oven mitts are able to withstand temperatures up to 357° C. (675° F.), and allow reaching into boiling water. According to the illustrated embodiment, receptacle 10 utilizes silicone within the same parameters as set forth by the FDA with respect to specified thicknesses and durometer.

Nevertheless, other pliable materials may be utilized without departing from the scope of the inventions. It shall be appreciated that any of a group of semi-inorganic polymers based on the structural unit $R_2SiO$, where R is an organic group, characterized by wide-range thermal stability, high lubricity, extreme water repellence, and physiological inertness can be considered in the silicone family of products.

Furthermore, the inventive drinkware may be customized or personalized, such as by the inclusion of logo 20 on receptacle 10, shown in FIG. 2. The unique properties of silicone allow the ability to apply printed or embedded physical logos to the outside surface or any other surface of the drinkware. Using appropriate inks and processes, these products can receive a variety of designs, and be used as retail housewares and promotional products.

Additionally, the silicone utilized can be produced in any Pantone color, or without pigment so as to be rendered nearly translucent. It is also possible to add to the raw material an additive that renders the finished cup phosphorescent (i.e. glow in the dark).

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. All equivalents, changes, and modifications that come within the spirit of the invention as described herein and/or by the following claims are desired to be protected.

What is claimed is:

1. A beverage receptacle for storing and dispensing beverages, the beverage receptacle comprising:
- a body member having
- a base portion,
- at least one sidewall stretching from said base portion to the top of said receptacle, the at least one sidewall and the base portion defining a cavity, and
- wherein the at least one sidewall is made substantially of silicone and the inner surface of said sidewall is smooth along its entire length in the direction away from said base portion.

2. The beverage receptacle of claim 1, wherein the at least one sidewall is entirely of silicone.

3. The beverage receptacle of claim 1, wherein the base portion is made substantially of silicone.

4. The beverage receptacle of claim 2, wherein the base portion is made entirely of silicone.

5. The beverage receptacle of claim 1, wherein the silicone is food-grade silicone.

6. The beverage receptacle of claim 4, wherein the silicone is food-grade silicone.

7. The beverage receptacle of claim 1, wherein the base portion is circular in shape.

8. The beverage receptacle of claim 7, wherein the body member is cylindrical in shape.

9. The beverage receptacle of claim 1, wherein the beverage receptacle is in the shape of a pint glass.

10. The beverage receptacle of claim 1, wherein the outer surface of the sidewall has a grip-enhancing texture.

11. The beverage receptacle of claim 1, wherein the sidewall is substantially transparent.

12. The beverage receptacle of claim 1, wherein the sidewall is substantially translucent.

13. The beverage receptacle of claim 1, wherein the sidewall comprises at least one decorative element.

14. The beverage receptacle of claim 1, wherein the beverage receptacle is in the shape of a mug.

15. The beverage receptacle of claim 1, wherein the beverage receptacle is in the shape of a wine glass.

16. The beverage receptacle of claim 1, wherein the beverage receptacle is in the shape of a shot glass.

17. The beverage receptacle of claim 1, wherein the beverage receptacle is in the shape of a tumbler.

18. A beverage receptacle for storing and dispensing beverages, the beverage receptacle comprising:
- a body member having
- a circular base portion,
- at least one circular sidewall stretching from said base portion to the top of said receptacle, the at least one sidewall and the base portion defining a cavity, and
- wherein the at least one sidewall and base portion are made entirely of food-grade silicone and the inner surface of said sidewall is smooth along its entire length in the direction away from said base portion.

19. A beverage receptacle for storing and dispensing beverages, the beverage receptacle comprising:

a body member having a circular base portion having a diameter between 2.25" and 2.75", at least one circular sidewall, stretching from said base portion to the top of said receptacle, having a vertical height between 5" and 6" and a thickness between 1/16" and ½", the at least one sidewall and the base portion defining a cavity, and an opening defined by the distal end of said at least one sidewall wherein the at least one sidewall and base portion are made entirely of food-grade silicone, the inner surface of said sidewall is smooth along its entire vertical height, and the opening has a diameter greater than that of said circular base.

* * * * *